United States Patent [19]

Berge

[11] Patent Number: 5,016,880

[45] Date of Patent: May 21, 1991

[54] COIN OR TOKEN-RELEASED GAMING MACHINE

[76] Inventor: Harald Berge, Bjerkeallen 33 A, N-1322 Hovik, Norway

[21] Appl. No.: 480,555

[22] Filed: Feb. 15, 1990

[51] Int. Cl.[5] ..... A63F 7/00

[52] U.S. Cl. ..... 273/138 A; 273/143 R; 273/355

[58] Field of Search ..... 273/138 A, 143 R, 355, 273/1 E

[56] References Cited

U.S. PATENT DOCUMENTS

| | | | |
|---|---|---|---|
| 4,373,732 | 2/1983 | Ogilvie | 273/271 |
| 4,448,419 | 5/1984 | Telnaes | 273/143 R |
| 4,624,459 | 11/1986 | Kaufman | 273/143 R |
| 4,844,464 | 7/1989 | Berge | 273/138 A |

FOREIGN PATENT DOCUMENTS

| | | |
|---|---|---|
| 139758 | 4/1978 | Norway . |
| 1202691 | 8/1970 | United Kingdom . |
| 1454046 | 10/1976 | United Kingdom . |
| 2131587 | 6/1984 | United Kingdom . |
| 2188182 | 9/1987 | United Kingdom . |

*Primary Examiner*—William H. Grieb
*Attorney, Agent, or Firm*—Frost & Jacobs

[57] ABSTRACT

A coin- or token-released gaming machine having a number of pay-out slots arranged in a coin panel, into which panel the user shoots a coin to hit one of the pay-out slots, the hitting of one such pay-out slot with a coin triggering a release mechanism to release a certain number of coins stored in the machine for the pay-out of a prize, whereas the missing of any such pay-out slot brings the used coin into a coin store or to internal or external recirculation for further use. In order to make the coin-released gaming machine more attractive and exciting as regards the chances of winning larger prizes than normal, the gaming machine comprises not only means for monitoring the total value of coins received, means for monitoring the total value of prizes paid out, means for setting a long term profit, means for setting a short term pay-out prize, as well as means for setting a special pay-out prize being larger than the short term pay-out prize, but also means for setting further special pay-out prizes.

12 Claims, 4 Drawing Sheets

COIN OR TOKEN-RELEASED GAMING MACHINE

FIELD OF THE INVENTION

The present invention relates to a coin or token-released gaming machine having a number of pay-out slots arranged in a coin panel, into which panel the user shoots a coin to hit one of the pay-out slots, the hitting of one of the pay-out slot with a coin triggering a release mechanism to release a certain number of coins stored in the machine for the pay-out of a prize, whereas the missing of any such pay-out slot brings the used coin into a coin store or for internal or external recirculation for further use.

BRIEF DESCRIPTION OF THE PRIOR ART

There are previously known such gaming machines which are equipped with mechanical devices for monitoring the pay-out prizes. Some of these devices are adapted to have a fixed pay-out prize for each pay-out slot, for example ten coins for hitting the central pay-out slot, whereas the paY-out prize gradually decreases, for example to three coins for the outermost slot at each edge. Any variation of the pay-out prizes is very difficult to achieve, and the adjustment of the long term income/pay-out ratio can only be achieved by manual adjustment of the infeed openings of the slots, which adjustment changes the statistic probability of hitting any slot, and thereby the above ratio. As a rule there is aimed for a long term average income of 20% for the owner of the machine, i.e. 80% of what is paid in, should be returned as pay-out prizes over a larger number of games. The infeed area of the slots are therefor adjusted (by trying and failing) for the achievement of the correct percentage. This might be a time consuming process.

From Norwegian patent specification 139758 (Lars Berg A/S) there is known a device in a coin-released gaming machine, comprising a pay-out mechanism which is programmed for continuously or periodically changing the pay-out prize. The continuous or periodic changes in the pay-out prizes according to the above Norwegian patent specification 139 758 are implemented by letting the individual display units arranged above each pay-out slot change their value within certain time intervals, at the same time as the pay-out mechanism is set to the value which at any time is displayed above the slots. Thus, the user of the machine must not only evaluate the strength of the stroke with which the coin is shot, such that one of the slots is hit, but the user must also let the coin hit the selected slot at a point of time securing an optimum pay-out prize. According to said Norwegian Patent Application it is suggested to change the pay-out prize value every second, such that the user must shoot the coin well in advance of the point of time at which the maximum value is displayed and ready to be paid out.

GB patent specification 1 454 046 (Gatley) discloses a fruit machine in which it is aimed for controlling the short term pay-out ratio of the machine, there being suggested means for monitoring the total value of coins paid in, means monitoring the total value of prizes paid out and means responding to departure of the ratio of the two values from a predetermined ratio and acting to alter the chance or value of prizes paid out in a subsequent game or games in a direction such as to tend to correct the ratio of the total values.

From GB patent specification 1 202 691 (Lennard) there is known a gaming machine comprising pay-out device for paying out the winnings at the end of each winning game, wherein a bonus win is obtainable after a predetermined number of winning games have been played. In addition there is suggested a bonus pay-out device, the operation of which is controlled directly or indirectly through a counting means, whereby operation of the bonus pay-out device is prevented until a predetermined number of win have been counted. This previously known bonus pay-out device is arranged as a part of another gaming machine which is different from the first gaming machine, said two machines being mutually operated through said counting means.

GB patent specification 2 188 182 (Parker) discloses a coin operated amusement machine, wherein the attainment by a player of one or more fixed targets generates a prize award, the amount of the prize being calculated on the basis of the target achieved, and of a prize fund within the machine, the prize fund varying in relationship to the amount paid in and the amount paid out in prizes in previous games.

GB patent specification 2 131 587 (Hagiwara) relates to an amusement device, wherein a plurality of pay-out schedules which govern the conduct of the game, are retained in a memory. The actual pay-out rate of the apparatus is based on random variations within a predetermined pay-out schedule. The prior art amusement devices relating to this specification, are discussed in the preamble of the same, and may comprise amusement devices wherein horses or other objects traverse a path during the game. Such an amusement device is for example disclosed in U.S. Pat. specification 4.373.732 (Brown et al) and the disadvantage in such prior art devices is the possibility for large winnings to occur soon after installation of a machine, even though the long term winnings have been set in accordance with a predetermined pay-out ratio. In order to reduce this disadvantage it is according to GB patent specification 2 131 587 suggested that there is automatically selected a pay-out schedule which is less favourable for the player when the winning in question goes beyond a predetermined limit. Thus, GB patent specification 2 131 587 suggests a plurality of pay-out schedules, for example four, and if a player exceeds the set pay-out limit, a disposition circuit automatically selects another pay-out schedule to alter the actual pay-out of the machine. However, even if GB patent specification 2.131.587 suggests a plurality of pay-out schedules, or pay-out tables which can give short term winnings and long term winnings of varying size, there is no suggestion of an accumulation of bonus which takes place over a long span of time, and which is paid out as a result of the general turnover in a coin- or token-released gaming machine.

Further, U.S. Pat. specification 4 624 459 (Kaufman) teaches a gaming device having random multiple pay-outs, and comprising a random number generator which generates a multiple pay-out random number for generating said random multiple pay-outs. However, this prior art gaming device does not give any instructions for accumulated pay-out prizes which are not fixed in advantage, but which are dependent upon the number of coins, and consequently the value thereof, which have entered the device, let alone any instructions for, at a later stage, determining a pay-out of the profit after the deposited coins have been evaluated in a computer unit.

Also in U.S. Pat. specification 4 448 419 (Telnaes) there is suggested a gaming machine of the type utilizing rotating reels which carry on the periphery a plurality of indicia, but no hint is given herein about a coin-released gaming machine including means for setting an owner's long term profit of a first percentage of the total number of coins received in such a machine, let alone means for setting a user's long term pay-out prize which in per cent is smaller than the balance between the long term profit percentage and the total number of coins received in the machine, and further means for setting a special pay-out prize based on the accumulated difference between said balance and said smaller pay-out prize, which finally after a number of succeeding games will give an accumulated difference to be paid out to the user as a jackpot-prize.

OBJECTS OF THE INVENTION

An object of the present invention is to provide a coinreleased or token-released gaming machine of the type defined in the preamble of this specification, and which represents a further improvement of applicant's gaming device as disclosed in U.S. Pat. specification 4.624.459.

Another object of the present invention is thus to provide a coin-released gaming machine which can be programmed in a far more versatile and variable manner than compared with previous gaming machines.

Yet another object of the present invention is to provide a coin-released gaming machine in which the short term pay-out prizes and the long term profit are completely supervised and controlled as well as appropriately adjusted.

Still another object of the invention is to provide a coinreleased gaming machine giving further possibilities of variations in the pay-out prizes, especially such pay-out prizes which are of the "jackpot" type, and especially for setting a plurality of different such pay-out prizes.

Another object of the present invention is to provide a coin-released gaming machine in which it is possible not only to alter the number of games from one jackpot to the next, but also the number of games and the time between such special jackpot prizes, and still combine this variation in games with alterations in the value of the short term pay-out prizes as well as in connection with an alteration of the value of the several jackpot prizes.

A further object of the present invention is still to provide a coin-released gaming machine in which the variation in the number of games from one jackpot to the next, is implemented in such a manner that it is practically impossible for a user to expect when the next jackpot prize is ready to be paid out, but in which the special, higher, further jackpot prizes makes the gaming machine still more attractive to the player.

An object of the present invention is also to provide a coin-released gaming machine in which the relation between the owner's long term profit, the short term pay-out prize and the special, accumulated jackpot pay-out prizes can be adjusted automatically so as to obtain a correct average ratio between owner's profit and player's pay-out.

BRIEF DISCLOSURE OF THE INVENTION

The above objects are achieved in a coin-released or token-released gaming machine of the kind set forth in the preamble, which according to the present invention comprises not only (a) means for monitoring the total value of the total number of coins received;
(b) means for monitoring the total value of prizes paid out;
(c) means for setting a long term profit;
(d) means for setting a short term pay-out prize; and
(e) means for setting a special pay-out prize larger than said short term pay-out prize; but which also comprises
(f) means for setting further special pay-out prizes.

In other words said means for setting further special pay-out prizes could comprise means for setting a first special pay-out prize appearing at a first frequent interval and with a first average amount, as well as means for setting a second special pay-out prize appearing at a second frequent interval and with a second average amount, and as well as means for setting a third special pay-out prize and with a third average amount, etc.

More specifically said means for setting the first special pay-out prize may set the first average amount of the first special pay-out prize at a lowest value, but at a highest pay-out frequency interval, for example on a day-by-day basis, whereas said means for the second special pay-out prize may set the second average amount of the second special pay-out prize at an intermediate value, and at an intermediate pay-out frequency interval, for example on a week-by-week basis, and wherein said means for setting the third special pay-out prize sets the third average amount of the third special pay-out prize at a highest value, but at a lowerest pay-out frequency interval, for example on a month-by-month basis.

BRIEF DESCRIPTION OF THE DRAWINGS

The invention will now be described more closely in the following with reference to the accompanying drawings.

DESCRIPTION OF PREFERRED EMBODIMENTS

Figure 1A:
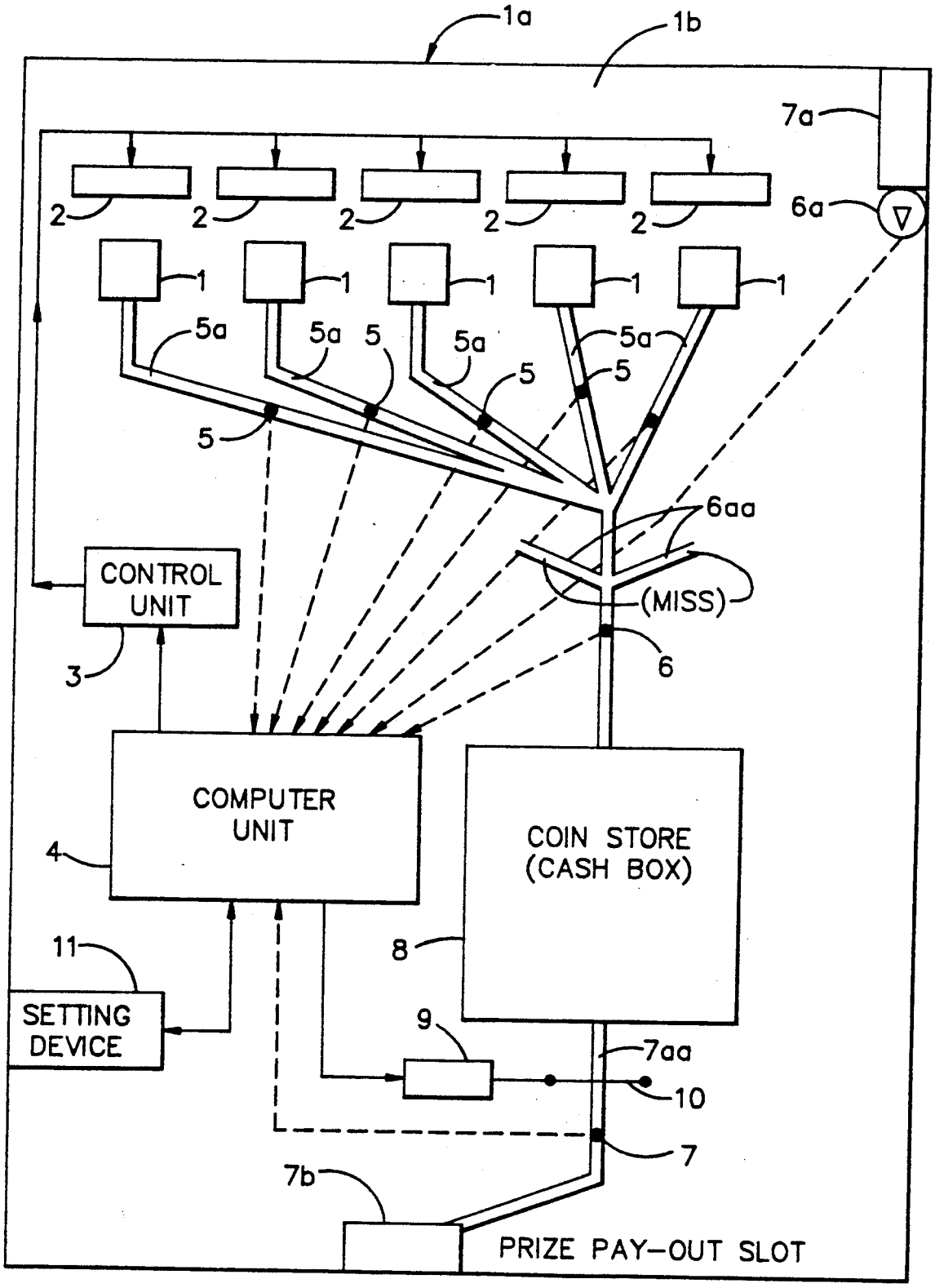
FIG. 1*a* is a diagrammatic front view of a combined coin panel of a pay-out machine and a block diagram related thereto of a first embodiment of a pay-out machine incorporating the present invention.

In FIG. 1*a*, which illustrates in a diagrammatic manner the physical components of a coin-released gaming machine and the individual connection thereof with the various control and monitoring means in a simplified block diagram, the general construction thereof might be of a kind as known per se. The coin-released or token-released gaming machine which in FIG. 1*a* is designated 1*a*, comprises a coin panel 1*b*, which in turn is provided with a plurality of pay-out slots, for example five slots 1, which define targets for coins which are fed into the machine, and which by the user is shot into the panel by means of a hand operated shooting mechanism. Above each target or pay-out slot 1 there is provided a display unit 2 which in a variable manner displays the pay-out prize in question before each game. The display units 2, which can be of a generally known LED or LCD type, are controlled from a control unit 3 which in turn reacts to information received from a computer unit 4. The computer unit 4 is adapted to receive information from a plurality of sensors which are provided at various positions in the coin panel 1*b*, and which supervise the movement of the various coins, i.e. the stage of coin infeed, the stage of a coin hitting a pay-out slot, a coin missing any pay-out slot, a coin approaching a coin store, or a coin being paid out through the coin store of the machine.

Thus, a first set of sensors 5 supervise any individual guiding path 5*a* from a pay-out slot 1, each of said sensors 5 submitting an electrical signal to the computer unit 4 for indicating that a coin has been received in any pay-out slot 1, and that a pay-out prize should be portioned out from the coin store 8 in accordance with the prize in question, i.e. the prize displayed on the corresponding display unit 2.

After having passed the guiding path 5*a* from a pay-out slot 1 the coin will be collected in the coin store 8, but before it has reached the coin store 8, the coin will pass a sensor 6 which registers all coins being fed into the machine.

If a coin having been fed into the machine and having been shot towards one of the pay-out slots 1 should miss the slots, the coin will follow one of a plurality of intermediate paths 6*aa* on its way to the coin store 8 after having been registered by the above mentioned sensor 6.

Possibly, the machine may also be constructed with a closed or semi-closed circulation path for a certain number of coins or tokens, in which case the coins used by the player could be circulated internally or externally for further use.

It should be noted that there is also provided an input sensor 6*a* which is located in the vicinity of the infeed slot 7*a* from which the coin fed into the machine, is shot towards the pay-out slots 1.

It should further be noted that another sensor 7 is provided in the outfeed path 7*aa* from the coin store 8, said sensor 7 supervising the number of coins being paid out after a pay-out prize has been awarded, and said outfeed path 7*aa* leading to a prize pay-out slot 7*b*.

In most of the games played by a user of the machine 1*a*, the coin which has been fed into the machine through the infeed slot 7*a* and shot therefrom by means of a not illustrated shooting means, will not hit any of the pay-out slots 1, and will then follow one of the intermediate paths 6*aa* to the coin store or cash box 8 after having been registered by the input sensor 6*a* and the coin store supervising sensor 6.

Upon hitting a pay-out slot 1 the coin will also pass to the coin store or cash box 8, and also in this case after having been registered by the input sensor 6*a* and the coin store supervising sensor 6. However, the coin which has hit a pay-out slot 1, will also pass one of the hit indicator sensors 5, which entails that a signal therefrom is transmitted to the computer unit 4, which immediately orders a dispenser mechanism 9 to open a locking means 10 in the pathway 7*aa* from the coin store 8, so as to enable paying out of that number of coins or tokens which corresponds to the pay-out prize displayed on the display unit 2 associated with the pay-out slot 1 which received the hitting coin. The control sensor 7 in the outfeed path 7*aa* from the coin store 8, not only supervises the total number of coins being paid out through the locking means 10, but also ensures that the correct payment is effected, by sending a control signal back to the computer unit 4.

Figure 1B:
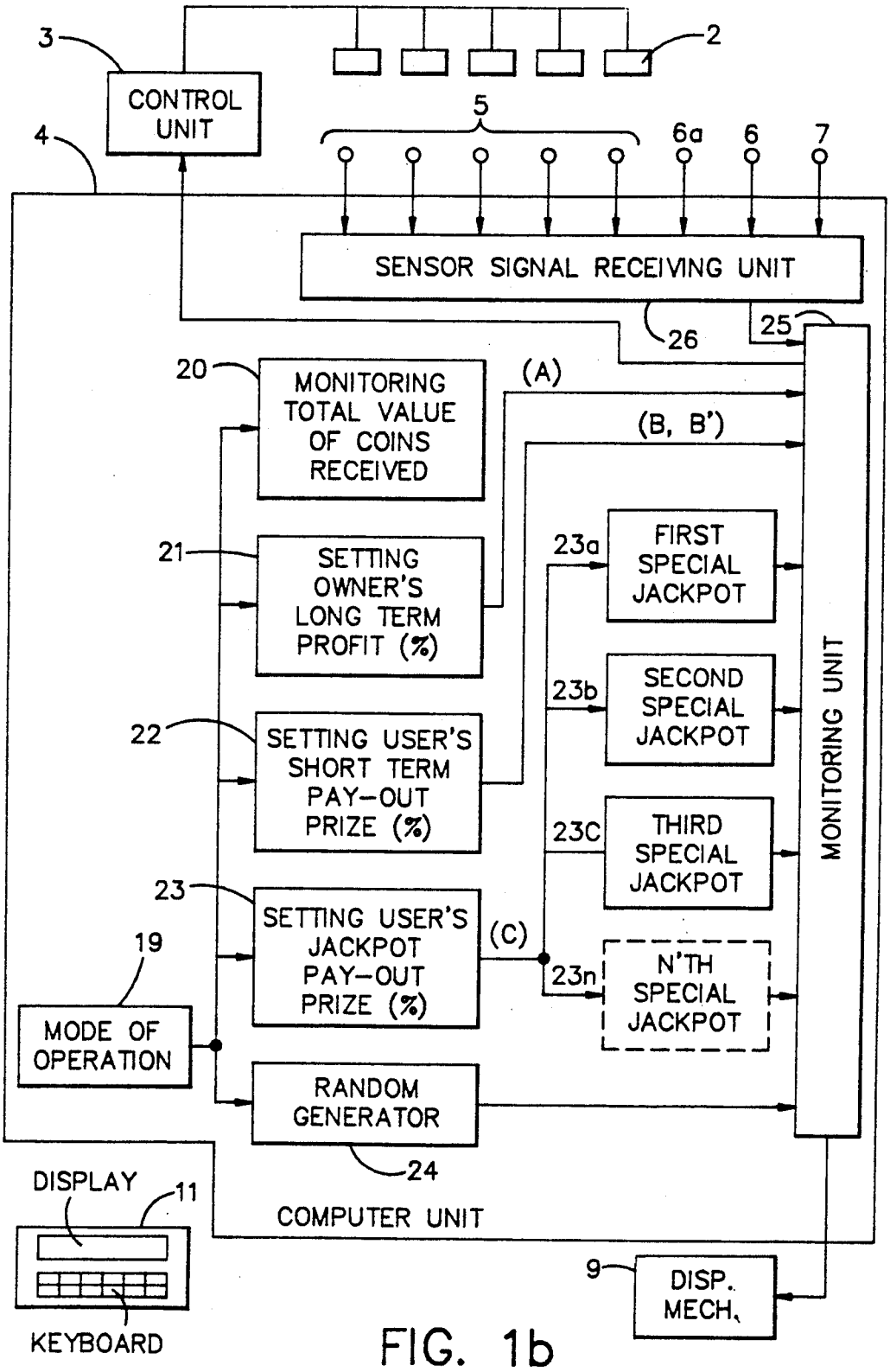
FIG. 1*b* is a block diagram of the electronic units included in the pay-out machine according to the invention.

The computer unit 4 is connected to a setting device 11 including a display unit 11*a* and a keyboard 11*b*, as this is further illustrated in the block diagram of FIG. 1*b*. The keyboard 11*b* is used for setting the computer unit 4, and in order to ensure that this setting is made by authorized staff only, the keyboard might be provided with a not illustrated locking and unlocking key.

The computer unit 4 will continually receive and at any time store information about the contents of the coin store 8. Further, the computer unit 4 has been set so as to adapt the value of any pay-out prize in accordance with the contents of the coin store, as this will be further explained in the following.

It is to be understood that the computer unit 4 comprises a superior program which ensures an appropriate ratio between owner's profit and player's pay-out prizes. Thus, a certain percent, here A percent, for example 20% is retained by the owner of the machine as profit, whereas the average balance of the total input, this average being denoted B%, and for example constituting 80% of the total input, should be paid back to the users of the machine.

However, the computer unit 4 in combination with the setting device 11 allow for a variation of this ratio B/A to be achieved in a manner which makes the playing of the machine even more attractive for the user One way of implementing this is, as disclosed in applicant's U.S. Pat. specification 4 844 464, to alter the above ratio to a A/B'/C ratio, for example 20/75/5, in which the C-portion or 5%-portion is accumulated in the coin store 8, for at certain intervals to be paid out as a jackpot pay-out prize which brings the average overall pay-out back to the stipulated B'+C=B% or 80%.

In FIG. 1*b* the superior program set by the setting device 11 is indicated by the block 19, which is further designated by "mode of operation".

This "mode of operation" block 19 controls a plurality of different control blocks, a first block 20 designated "monitoring total value of coins received", a second block 21 designated "setting owner's long term profit (%)", a third block 22 designated "setting short term pay-out (%)" and a fourth block 23 designated "setting of jackpot pay-out (%)".

As indicated in FIG. 1*b* there is also included a series of sub-blocks 23*a*, 23*b*, 23*c*.....23*n*, which indicate that according to the present invention there are provided means for setting further special pay-out prizes.

Thus, said means 23*a*.....23*n* for setting further special pay-out prizes comprise a first block 23*a* for setting a first special pay-out prize appearing at a first frequent interval and with a first average amount, whereas the block 23*b* represents means for setting a second special pay-out prize appearing at a second frequent interval and with a second average amount, whereas block 23*c* for example may represent means for setting a third special pay-out prize and with a third average amount, etc.

If, as an example there are used three such blocks for setting special pay-out prizes, for example the blocks 23*a*, 23*b* and 23*c*, said block 23*a* may be adapted for setting the first average amount of the first special pay-out prize at a lowest value, but at a highest pay-out frequency interval, for example on a day-by-day basis, whereas the block 23b may be adapted for setting the second average amount of the second pay-out prize at an intermediate value, and at an intermediate pay-out frequency interval, for example on a week-by-week basis, and wherein block 23c may be adapted for setting the third average amount of the third special pay-out prize at a highest value, but at a lowest pay-out frequency interval, for example on a month-by-month basis.

While still contemplating the use of said three blocks 23a, 23b and 23c, the previously mentioned ratio of A/B'/C will in this embodiment be further split into the ratio A/B'/C1/ C2/C3, wherein the previously mentioned C-portion or the 5%-portion is split into for example 2.5% - 1.5% - 1%, relating to the lowest but must frequent, intermediate, and highest but most infrequent special prizes, respectively.

It is to be understood that by using the computer unit 4 it is also possible to program a variation in the number of games from not onlY one first special jackpot prize to a next first special jackpot prize, but also between the other special jackpot prizes, so as to make it more difficult for a player, or more exiting for the player, to detect a possible sequence in the appearance of any ordinary or special jackpot pay-out prize.

Such a random presence of the jackpot prizes might be implemented by means of a random generator 24, which in FIG. 1b is connected to the "mode of operation" block 19 to receive information therefrom, and which has its output connected to a monitoring unit 25 which also receives information from the above described blocks 20, 21, 22 and 23, 23–23n, as well as from the block 26 designated "sensor signal receiving unit". The monitoring unit 25 monitors the dispenser mechanism 9 which, as described above initiate the release of the correct number of coins, all in accordance with the mode of operation in which the computer unit 4 has been set, and in accordance with the various accumulated short term pay-out prize and special jackpot pay-out prizes, respectively.

Figure 2A:
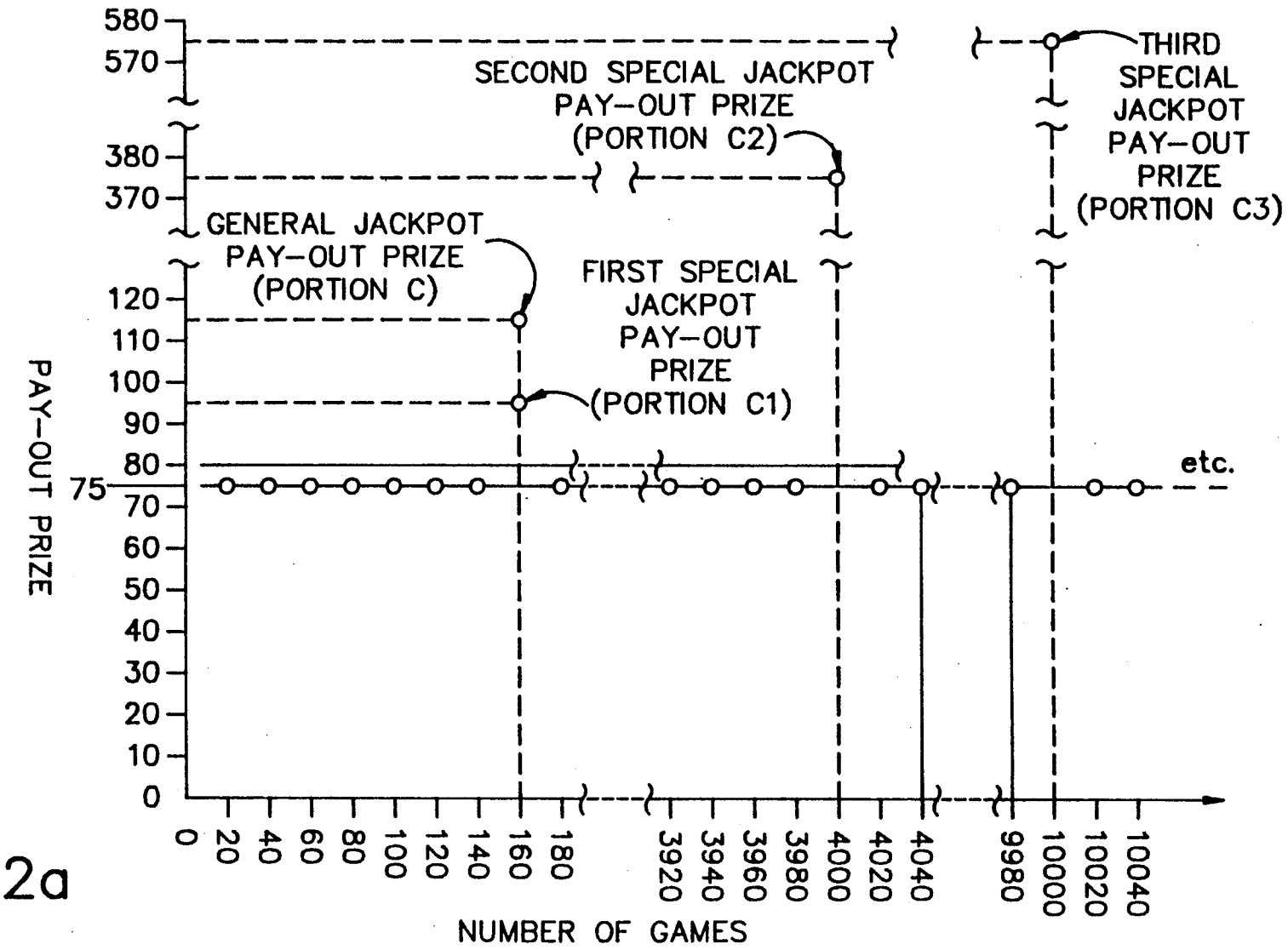
FIG. 2*a* is a graph illustrating an example of variations in short term pay-out prizes and a plurality of jackpot prizes related to a large number of games.
Figure 2B:
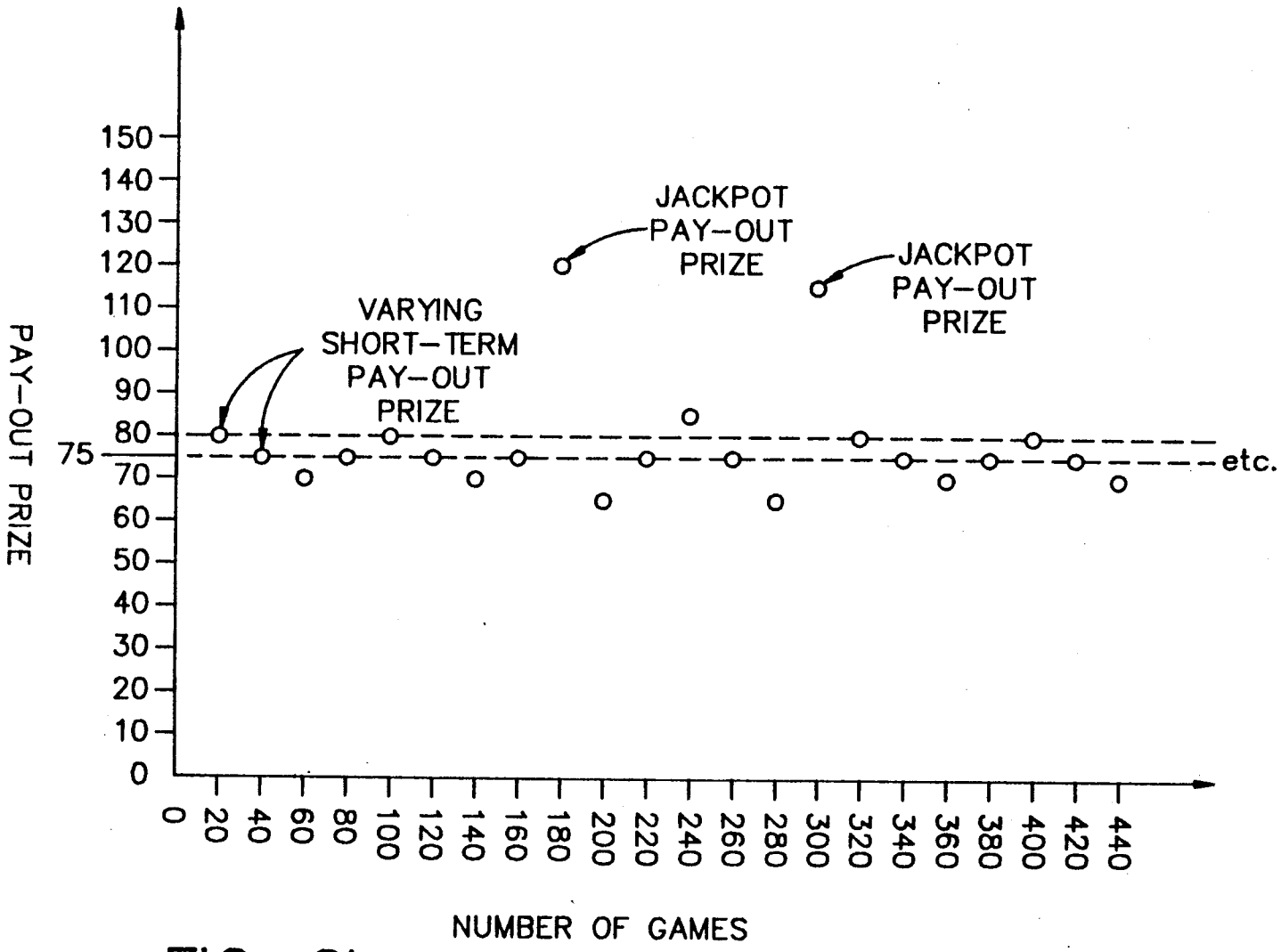
FIG. 2*b* is a graph illustrating another variation of short term pay-out prizes and a plurality of special jackpot prizes related to a large number of games.

In FIGS. 2a and 2b there are illustrated examples of what can be achieved with the improvement in a coin-released gaming machine according to the invention.

In FIG. 2a the abscissa of the graph illustrates the number of games, whereas the ordinate depicts the individual pay-out given by the setting or mode of operation of the computer unit 4. In order to simplifY this example it is assumed onlY one pay-out slot. Further, it is assumed that the probability for hitting this pay-out slot is 5%, and that this probability of hitting the slot is met by hitting the slot after each twentieth game, which in fact is a very coarse simplification. Besides, this estimated probability is extremely low in this connection.

Further, it is assumed that the value of the coin is 5, such that upon game number 20, which according to the above coarse assumptions will give rise to a so-called "reduced" or ordinary "short term" pay-out prize, there is in the coin store 8 of the machine 1a (in addition to a previous, unspecified amount) a value amounting to 100. The first pay-out prize which will occur at game number 20, can for example be programmed to be fixed at a percentage B' amounting to 75, i.e. the reduced ordinary short term pay-out prize. After a certain number of such pay-out prizes there will at game number 160 appear a jackpot pay-out prize, which in case the percentage C of a general jackpot pay-out prize amounts to 5% will amount to 115, which is made up by the previous percentage B' of 75 and the accumulated $8\times5\%$, amounting to 115, and which thereby brings the average payout up to 80.

However, according to the present invention, this C-portion of the pay-out prize may be further split up into subsidiary portions, for example a first portion C1 amounting to 2.5% and representing a first special jackpot, a second portion C2 amounting to 1.5% and representing a second special jackpot, as well as a third portion C3 amounting to 1% and representing a third special jackpot, of which the first portion C1 should have a lowest value but appearing at a highest pay-out frequency interval, whereas the second portion C2 should be set as an intermediate value and at an intermediate pay-out frequency interval, and wherein the third portion C3 should be sat at a highest value but at a lowest pay-out frequency interval. This further split up of the C-portion is also illustrated in FIG. 2a, in which further special jackpot prizes appear.

Thus, in FIG. 2a there is also illustrated, at game number 160, a first special pay-out prize which is made up by the ordinary 75% plus the accumulated value of $8\times2.5\% = 20$, making a total of 95, i.e. made up of the accumulated portion C1 (2.5%).

Thus, at for example game 4000 there will also appear a second special jackpot pay-out prize, which is made up of the accumulated portion C2 (1.5%), and this accumulation has occurred for $4000/20 = 200$ times, resulting in a total accumulated jackpot prize of $200\times1.5+75=375$.

Further, at for example game number 4000 there appears a third special jackpot pay-out prize, which is a result of the accumulated C3 portion, which has accumulated $10000/20=500$ times, giving us a result $500\times1+75=575$ as a value of the third special jackpot pay-out prize.

It is to be understood that the above portions C1, C2 and C3 can be varied not only as regards their values, but also as regards their frequency of appearance.

As an example the first special jackpot prize may occure several times a day, whereas the second special jackpot prize may be set so as to appear for example one or more times a week, and whereas the third special jackpot prize may appear one or more times a month.

The number of games which have to be played before any jackpot occurs, can for example be determined in accordance with output from the random generator 24 included in the computer unit 4. If for example the first special jackpot pay-out prize is set to appear not necessarily after 8 normal short term pay-out prizes, but for example after 11 normal long term prizes the general jackpot pay-out prize at a ratio C of 5% would then have accumulated to a value of $75+12\times5=135$.

Alternatively, if the first jackpot pay-out prize is evaluated at a portion C1 of 2.5% this jackpot would amount after 11 normal short term pay-out prizes to $75+12\times2.5=105$, which is different from 95 relating to the first special jackpot prize appearing after 8 ordinary short term pay-out prizes.

It is further to be understood that also the second special jackpot prize and the third special jackpot prize to the portions C2 and C3, respectively, may be altered as appropriate, both randomly and by means of any other sequential pattern.

In effect, the manner in which the pay-out is effected will be much more complicated than explained above, the reasons thereof being as follows:

Firstly, there are usually involved a plurality of pay-out slots having different pay-out prizes. In case of five pay-out slots the ratio between the pay-out prizes might for example be represented by the FIGS. 3-5-7-5-3, the middle slot being designed for maximum pay-out prize. The computer unit 4 will however calculate the probability of pay-out prize for each game, and then with a distribution between the various slots as close to the desired distribution as possible.

Due to the plurality of possibilities of pay-out prizes the picture illustrated in FIG. 2*a* will be much more complicated, since the pay-out prize in question depends on which slot is hit by a coin. Thus, the accumulation of a jackpot prize might be much more rapid when a slot of lower order is hit, in which the short term pay-out prize is relatively lower than that compared with the middle slot. However, this is taken care of by the computer unit 4 which at any time receives and processes information about the contents of the coin store 8. The computer unit 4 can also be set to prepare a jackpot when a predetermined number of games have been played after the previous jackpot prize, provided the random generator 24 has not ordered a jackpot prize earlier.

Secondly, the casualty as regards the point of time when hitting any slot will result in that the pay-out prizes will be dispensed in a more randomly manner than illustrated in FIG. 2*a*. In principle this will not be any drawback since the computer unit 4 can also cater for these conditions. However, the computer unit 4 will be able to analyze the statistic distribution of hits, and by the registration of statistic significant deviations form the given preconditions for average profit over a great number of games, be able to close the gaming machine for readjustment of the program parameters.

The computer unit 4 can also be set for further variations of the size and the occurrence of the pay-out prizes. The computer unit 4 can for example in accordance with a preferred setting make a change in which slot is to initiate the dispense of the highest pay-out prize.

Besides, further variations in relation to what is illustrated in FIG. 2*a* can be set as regards the size of the pay-out prizes, as this is illustrated in FIG. 2*b*.

In FIG. 2*b* there is chosen a sinus-like variation of the general short term pay-out prizes around the "lowered" average of 75%, including special jackpot prizes which may appear in a similar manner as discussed in connection with FIG. 2*a*. It should be noted that the same simplifications as discussed above are also assumed in connection with FIG. 2*b*. In the example illustrated in FIG. 2*b* the amplitude of the "sine"-variations between each jackpot is also altered to render further variation in the game.

The pay-out prizes rendered possible by each game are calculated at any time by the computer unit 4 and are presented on the display units 2, such that prior to a game the user can see what chances are available for the coming game. The player can then be confronted with the possibility that the chances will vary from one game to the next, and in certain cases these changes might be drastic.

For example, when a special jackpot prize is to be paid out, all of the slots may be set to initiate the pay-out thereof, which means that the player can receive this special prize without exercising any expert skill.

A lowermost pay-out limit must necessarily be set by the setting device 11, such that the gaming machine does not lose its attraction at any time.

The inner structure of the computer unit 4 might be provided in accordance with normal microprocessor and data techniques, and the setting, mode of operations and programs to be used can either be implemented as relay circuitry, logic elements, printed circuit boards, or software programming, the selection thereof being dependent upon the field of application and the physical size of the gaming machine itself.

As appearing from the above description which only describes a few examples of embodiments, the improvement according to the present invention will meet all the objects listed in the preamble of the specification.

Further, the improvement according to the invention makes it possible to vary the special pay-out prizes in a far more interesting way than previously, and the improvement also takes care of the fact that the average profit and the average pay-out prizes can be maintained without frequent readjustment of the control circuitry. With the present improvement the coin-released gaming machine associated therewith might in principle be made self-adjusting within certain limits.

It is to be understood that further embodiments including the improvement according to the invention can be implemented over and above the embodiments illustrated herein, the spirit and the scope of the present invention being defined by the appending claims.

What is claimed is:

1. In a coin-or token-released gaming machine having a number of pay-out slots arranged in a coin panel, into which coin panel a user shoots a coin in an attempt to hit one of said pay-out slots, the hitting of any of said pay-out slots with a coin triggering a dispenser mechanism to release a certain number of coins stored in said machine for the pay-out of a prize, whereas missing any of said pay-out slots brings the used coin into a coin store or for internal or external recirculation for further use, said gaming machine also comprising in combination:

(a) means for monitoring the total value of the total number of coins received;

(b) means for monitoring the total value of prizes paid out;

(c) means for setting a long term profit;

(d) means for setting a short term pay-out prize;

(e) means for setting a special pay-out prize larger than said short term pay-out prize; and (f) means for setting further special pay-out prizes.

2. Machine as claimed in claim 1, wherein said means for setting further special pay-out prizes comprise means for setting a first special paY-out prize appearing at a first frequent interval and with a first average amount; means for setting a second special pay-out prize appearing at a second frequent interval and with a second average amount; and means for setting a third special pay-out prize and with a third average amount; etc.

3. Machine as claimed in claim 2, wherein said means for setting the first special pay-out prize set the first average amount of said first special pay-out prize at a lowest value, but at a highest pay-out frequency interval, wherein said means for setting said second special pay-out prize set the second average amount of the second special pay-out prize at an intermediate value, and at an intermediate pay-out frequency interval, and that said means for setting said third special pay-out prize set the third average amount of said third special pay-out prize at a highest value, but at a lowest pay-out frequency interval.

4. Machine as claimed in claim 1, wherein said means for setting a long term profit are adapted to given a long term average profit of a first percentage of the value of the total number of coins received in said machine, said means for setting a short term pay-out prize is adapted to give a pay-out prize which in percentage is smaller than the balance between said first long term average profit percentage and the total number of coins received in said machine, and said means for setting special pay-out prize is adapted to accummulate the difference between said balance and said short term pay-out prize, said accumulation being assigned to at least two different special pay-out accumulation means, whereby, after a given number of succeeding games, the accumulated difference will be paid out as a lesser or larger jackpot prize.

5. Machine as claimed in claim 4, wherein said means for setting said special pay-out prizes are adapted to release said special jackpot prize according to the occurrence of a randomly varying number of usual long term pay-out prizes.

6. Machine as claimed in claim 1, wherein the means for setting a short term pay-out prizes are adapted to bring forth pay-out prizes varying below and above average smaller pay-out prizes, and the means for setting the special jackpot prizes and the means for setting the further special jackpot prizes are adapted to accumulate the average values of said smaller pay-out prizes for the bringing forth of said jackpot prizes.

7. Machine as claimed in claim 1, wherein the setting of the percentages related to means (c), (d), (e) of claim 1, are 5%/20%/75%, in which the 5% term is accumulated to constitute jackpot pay-out prizes by further relation 2.5%/1.5%/1% relating to lowest but most frequent, intermediate, and highest but most infrequent special prizes, respectively.

8. Machine as claimed in claim 1, wherein the pay-out prizes in question are made dependent upon the pay-out slot which is hit by a coin, said means for setting the short term pay-out prize being adapted for computing the pay-out prize in relation to the location of the slot in question as well as the statistically computed prerequisites of average profit.

9. Machine as claimed in claim 1, wherein is provided a plurality of display units, each unit being arranged adjacent a corresponding pay-out slot for indicating the value of the pay-out prize in question for each slot.

10. Machine as claimed in claim 1, wherein said means for setting a short term pay-out prize include a limit for lowest value.

11. Machine as claimed in claim 1, wherein said means of claim 1 are included in an on-line programmable processing unit.

12. Machine as claimed in claim 1, wherein said special pay-out accumulation means are monitored by a computer unit which is programmable through a setting device, for example a keyboard, so as to allow for variation in said adjustable settings.

* * * * *